US010098514B2

(12) United States Patent
Roll

(10) Patent No.: US 10,098,514 B2
(45) Date of Patent: Oct. 16, 2018

(54) TOILET PLUNGER HOLDER

(71) Applicant: Honor Rene'e Roll, Trussville, AL (US)

(72) Inventor: Honor Rene'e Roll, Trussville, AL (US)

(73) Assignee: Patrick Rocco Roll, Jr., Leeds, AL (US)

( * ) Notice: Subject to any disclaimer, the term of this patent is extended or adjusted under 35 U.S.C. 154(b) by 282 days.

(21) Appl. No.: 15/174,768

(22) Filed: Jun. 6, 2016

(65) Prior Publication Data

US 2017/0347846 A1 Dec. 7, 2017

(51) Int. Cl.

| | |
|---|---|
| ***B32B 3/10*** | (2006.01) |
| ***A47K 17/00*** | (2006.01) |
| ***E03C 1/308*** | (2006.01) |

(52) U.S. Cl.

CPC ..... *A47K 17/00* (2013.01); *E03C 1/308* (2013.01)

(58) Field of Classification Search

None

See application file for complete search history.

(56) References Cited

U.S. PATENT DOCUMENTS

| | | | | |
|---|---|---|---|---|
| 2002/0023308 | A1* | 2/2002 | Blum | A47L 23/22 15/104.002 |
| 2004/0141311 | A1* | 7/2004 | Chen | A63H 33/18 362/84 |
| 2005/0079330 | A1* | 4/2005 | Tanel | A47L 23/266 428/204 |

* cited by examiner

*Primary Examiner* — Christopher M Polley

(57) ABSTRACT

The present invention is a device for storing an unused toilet plunger and providing easy access when plunger is need. The plunger holder is mold and mildew resistant and machine washable. It consists of a waterproof mat with a vertically raised edge around its surface edge to prevent soiled plunger water from dripping off of the mat and onto the floor or surface. The mat can be of a solid color or clear, showing the floor color through. It can also have a design which is bound between two layers of rubber, a base layer and a clear top layer. The holder is small and can conveniently fit beside and to the rear of the toilet where most plungers are already kept.

4 Claims, 3 Drawing Sheets

TOILET PLUNGER HOLDER

BACKGROUND OF THE INVENTION

This invention relates generally to household tools such as a toilet bowl plunger or kitchen plunger. More particularly, the invention is located in the bathroom for resting a toilet bowl plunger, keeping the floor dry of dirty toilet water after the plunger is used. The feature of a vertically raised edge around the edge of the mat or holder prevents the soiled water from spilling to the floor. The terms mat and holder refer to the present invention and are to be used interchangeably.

Drains throughout the house can become problematic, deeming it appropriate to have more than one waterproof mat. You would not use a toilet plunger in the kitchen sink. There would be a "clean" plunger for jobs such as this. This invention is very simple to manufacture and would be affordable to own more than one. It is small and would fit comfortably in the cabinet beneath the kitchen sink to rest a short handle plunger. It is perfect for fitting in the bathroom, beside and to the rear of the toilet bowl or between the bath tub and the toilet bowl.

Most retail choices of toilet plunger holders do not work with every size plunger. And, the holder does not guarantee they will not tip over during removal or replacement of the toilet plunger. Replacing the plunger must be done slowly because the holder is only big enough to fit the correct size plunger, it could easily tip over onto its side or just skid across the floor.

An example of a plunger holder is U.S. Pat. No. 6,951,281 B1—by Jeffery. This invention, though more compact than most of the other plunger receptacles, is a holder that has hinges used to open and close the flaps where the toilet plunger is inserted at the top of the canister, these hinges could break and become unusable, any movable parts can malfunction or break leaving the holder unusable. The holder must be cleaned by hand and is not mold and mildew resistant. It is not small enough to fit in the small space to the side and rear of the toilet bowl and maneuver flaps to open and close for removal and replacement of a plunger.

Other choices are toilet plunger canisters or receptacles. These can be very costly and will not fit in every bathroom comfortably. They are large and bulky, most having movable parts during removal and replacement of the plunger. An example of such designs are U.S. Pat. No. 5,836,322 A—by Borger and Borger, a very large canister, large enough to hold enough cleaning solution to cover the plunger and some of the handle. What if it was covered with solution at the time of an emergency. Contaminated cleaning solution would splash on both, quick removal of the plunger and replacement.

Another example of a canister is U.S. Pat. No. 7,900,287 B2—by Wildauer, Agami, and Metaxatos, this patent uses disposable plunger cups and disposable cleaning pads. There is a spring mounted on the handle used to attach and detach the disposable toilet implements. The handle and the disposable implements are kept in a large canister. A foot pedal is used to open and close the door flaps. This must be kept replenished. It could be too easy to run out of plunger cups and cleaning pads. What if plunging was required repeatedly? You could choose to keep the same disposable plunger on the handle, but it would have to be stored on the floor. There is no place to save a dirty plunger attached to the handle in this canister. The floor would become contaminated with toilet water.

And, U.S. Pat. No. 5,335,374 A—by Wilk and Wilk, this patent has a spring-loaded latch that allows the handle to telescope in on itself, making the handle of the plunger shorter. This would take entirely too long to open and ring the hole with the spring-loaded latch in an emergency, especially if you were a guest in some-one else's home and the toilet overflowed. How embarrassing that would be. The variety of different canisters it can be housed in are large and cannot fit in small areas. Removing the plunger from the canister and then lengthening the handle is entirely too much time wasted.

Another containment system must use a specific plunger to fit within the tray. It is U.S. Pat. No. 20140116902 A1 by Dressel, DRESSEL, MARKU, and Webb. It has many parts and also disposable implements that must be kept replenished. This could become a huge inconvenience and would be costly. This containment system is not mold and mildew resistant or machine washable and must be cleaned by hand. The cover to this tray only covers half of the tray and thus only half of the plunger. The cover must be put into place manually.

If someone had company visiting and they had no idea how to operate a plunger receptacle, and they needed the plunger immediately, the time it would take to maneuver the plunger loose of its doors and flaps could be devastating to the bathroom floor and other accessories. Not to mention the embarrassment it would cause.

The above holders and receptacles and toilet plungers that go with these receptacles have either spring loaded latches, hinges, screws, rivets, adhesives, or a foot pedal to operate their doors or flaps, and are not guaranteed not to tip over. Any of these with movable parts only increase the risk of breaking. Many of these have several parts to keep up with, these could be separated and lost leaving the device unusable. What is needed is a device that overcomes all of these objectives. A devise that keeps toilet water off of the floor. A devise that is small enough to fit beside and to the rear of the toilet. What is also needed is a device that is pleasing to the eye, decorative. Also, something that is mold and mildew resistant and does not have to be cleaned manually but can be cleaned in a washing machine. What is also needed is the guarantee of the holder not to tip over. And most important is the need for speed, to just pick up the plunger when needed and use it, leaving no chance for an overflow of toilet products if at all possible. The present invention offers all of this.

There are many receptacles, canisters and holders that have been patented but there is nothing patented that resembles this plunger holder. One that is small with a vertically raised edge to prevent water runoff. One that is so simple to manufacture, and cost effective. One that can hold any standard plunger. One that is mold and mildew resistant and machine washable. One that can be used immediately without any cause of hesitation.

BRIEF SUMMARY OF THE INVENTION

A principal aspect of the present invention is to provide an attractive plunger holder, adding a colorful accent to the room.

Another aspect of the present invention is to be made of a durable, bendable, waterproof material.

Another aspect of the present invention is to provide a waterproof mat with a vertically raised edge to prevent spillage to the floor or surface area.

Another aspect of the present invention is to guarantee that this holder will not turn over or skid across the floor during removal or replacement of the toilet plunger.

Another aspect of the present invention is to provide a plunger holder that is not big and bulky but small and able to fit beside and to the rear of the toilet where most plungers are kept.

Another aspect of the present invention is to offer a toilet plunger holder that has no movable parts or hinges that could break or parts that could separate and become lost from the device, leaving the device unusable.

Another aspect of the present invention is to provide a plunger holder which uses any standard plunger.

Another aspect of the present invention is to provide a mold and mildew resistant device that stores a toilet plunger.

Another aspect of the present invention is to provide easy cleaning of the holder such as cleaning the mat in the washing machine.

Another aspect of the present invention is to provide a device that has easiest access and plunger usability for the elderly and handicapped, and others.

Another aspect of the present invention is its simple design, making it less costly to manufacture.

Another aspect of the present invention is it can be manufactured in different shapes.

Another aspect of the present invention is to offer a variety of designs and colors, to provide the customer with a bathroom accessory they will enjoy, and fill a great need. The waterproof mat can be manufactured with clear rubber, allowing the floor to be seen through the mat. It can be different colors and shapes to accent the bathroom decor. It can bear logos, advertisements, and football or sports team letters for the die-hard sports fan. It makes a beautiful bathroom accessory and can become a topic of conversation.

The bathroom plunger is most always rinsed clean in the toilet then shaken before returning to its resting place to the side and rear of the toilet bowl. The present invention allows people to keep placing their toilet plunger in this small little area beside the toilet, but with a sigh of relief that the toilet water is not going onto the floor. After shaking the plunger when finished clearing the drain, the amount of water to drip from the plunger is not too great, even with repeated use. The special feature of the vertically raised edge ensures safety from water runoff. The mat provides dryness to the floor, color or design and easy cleaning by a washing machine.

Other aspects of the present invention will become apparent from the following detailed description of the invention along with the accompanying drawings. The detailed description and drawings are examples of the invention, rather than leaving it solely to the claims to describe.

DETAILED DESCRIPTION OF THE INVENTION

Figure 1:
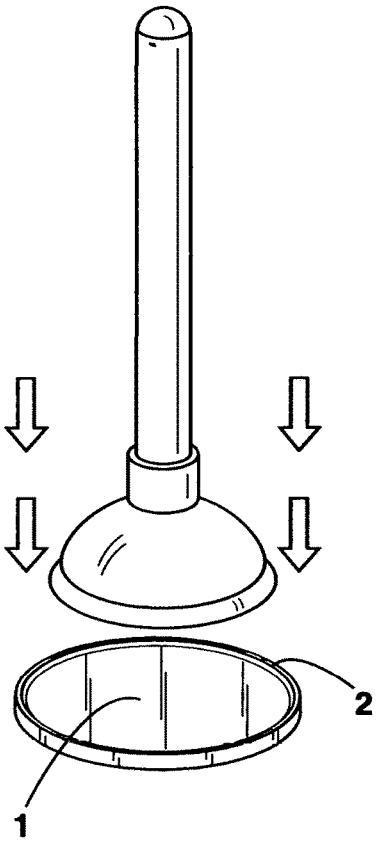
FIG. 1 is a perspective view of the mat of the invention showing the plunger being positioned onto a circular mat.
Figure 3:
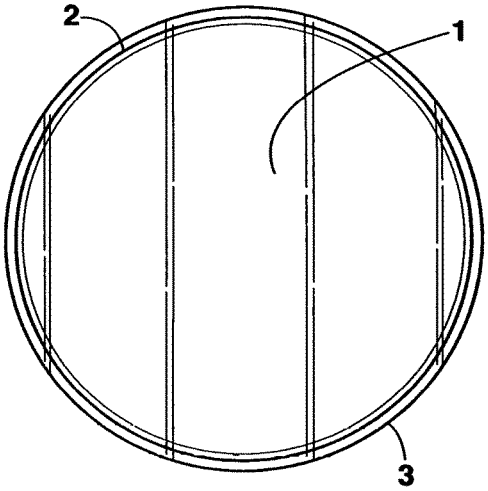
FIG. 3 is a perspective top view of the mat of the invention showing the flat surface of the mat and a vertically raised edge around the circular shaped mat.

FIG. 1 and FIG. 3 The waterproof mat can be made of rubber, or a rubber compound, or other waterproof bendable materials. The mat is made by a molding or injection molding process. It is a simple device and easy to manufacture as well as cost effective. The choice material is rubber or rubber compound. It is mold and mildew resistant, and machine washable. Very durable and easy to clean.

Figure 4:
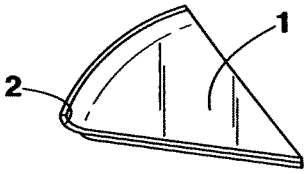
FIG. 4 is a sectional view of the mat showing the flat surface of the mat and a vertically raised edge molded in one piece.
Figure 5:
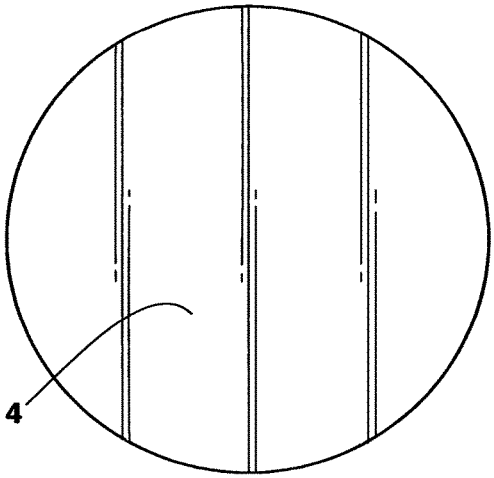
FIG. 5 is a perspective bottom view of the mat of the invention showing the area of mat to be placed directly onto the floor.
Figure 10:
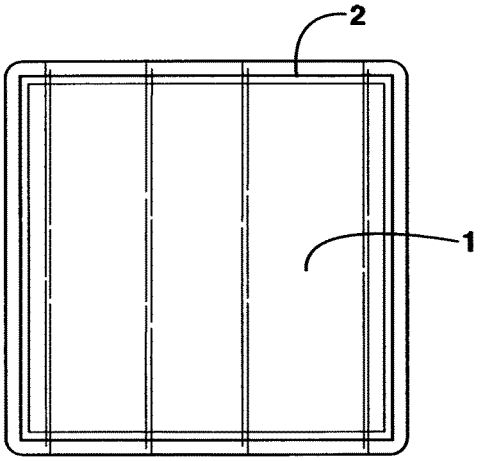
FIG. 10 is a perspective view of a square mat of the invention showing an example of a different shape with a vertically raised edge.

The invention can be different colors, FIG. 10, FIG. 3 and shapes. The distinct feature found 1 on the mat is its FIG. 4, number 2 vertically raised edge to prevent contaminated water from spilling off of the mat and onto the surface or floor. FIG. 1, FIG. 5 It is flat and therefore impossible to turn over. FIG. 5, number 4 The waterproof material used in manufacturing the mat and the size of the bottom surface area in contact with the floor prevents the mat from skidding across the floor during removal FIG. 1 or replacement of the plunger.

Figure 8:
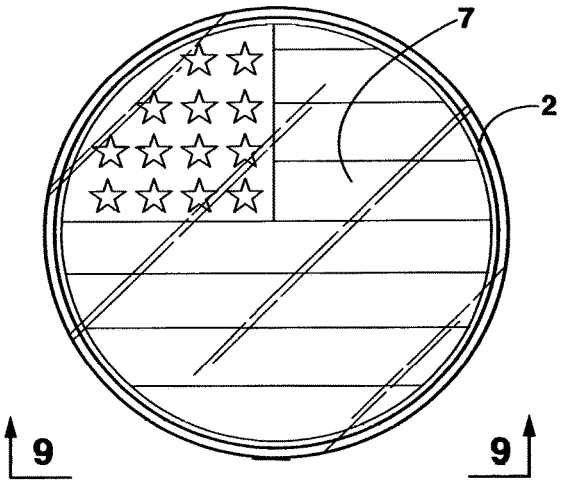
FIG. 8 is a perspective top view of the mat of the invention showing a flat surface of the mat with a design and vertically raised edge around its periphery.
Figure 9:
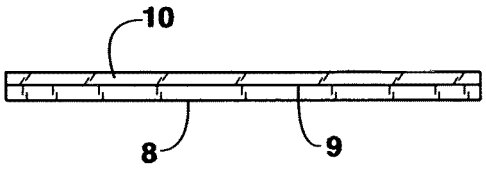
FIG. 9 is a perspective side view of the mat with a design of the invention showing a bottom layer and a top layer bound together with a fabric design in between the two layers.

The mat can come in solid colors or clear rubber, showing the floor color through the mat. It can have FIG. 8, number 7 a design, logo, advertisement, team sports letters, or mascots FIG. 9, number 9 bound between 8, 10 two layers of rubber. This process of manufacturing would include taking 8 a layer of rubber mat, as the bottom layer, and placing 9 on top of the bottom layer a design, then 10 placing a clear top layer of rubber over the design and binding them together. The surface edge of the mat always being vertically raised. The design can be made of fabric or other durable material that will allow the layers to bind together.

Figure 6:
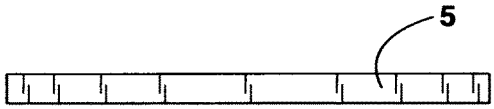
FIGS. 6 and 7 are perspective left and right side views of the mat of the invention showing the sides of the mat with the vertically raised edge molded as one piece.
Figure 7:
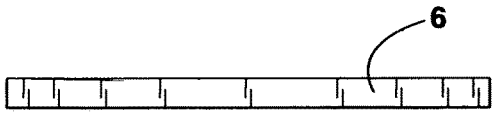

FIG. 6, number 5 and FIG. 7, number 6 are the 5 left and 6 right side view of a single layered mat with a vertically raised edge. It is shown as one piece because it is molded as one piece. The single layered mats are either clear rubber or colored rubber mats.

Binding two layers together with a choice design really allows for a variety of designs and colors to be offered to the retail shopper. Not only offering a great accent of color to the room; but, allowing the plunger to remain to the side and rear of the toilet where it is usually kept because of the mats small size. It can go virtually any place the plunger can rest. The canisters and receptacles holding plungers are all too large to fit there.

Figure 2:
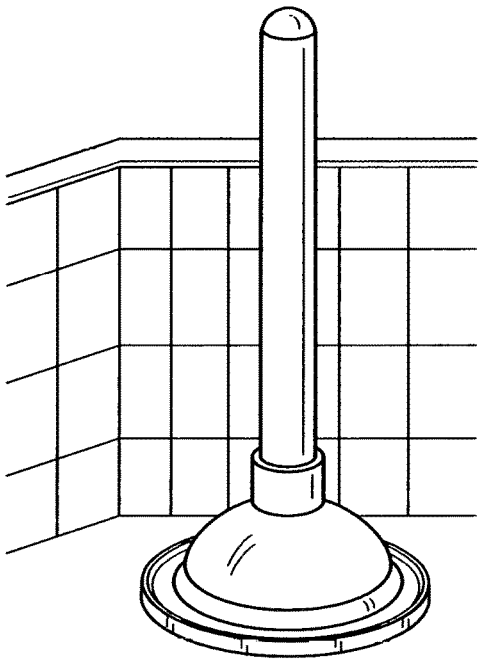
FIG. 2 is a perspective view of the plunger properly positioned on the mat.

It is important to have a plunger in easy reach and ready for immediate use when a toilet begins to overflow. Large and bulky canisters and receptacles include: U.S. Pat. No. 5,836,322 A inventors Borger and Borger; U.S. Pat. No. 7,900,287 B2 inventors Wildauer, Agami, and Metaxatos; and U.S. Pat. No. 5,335,374 A inventors Wilk and Wilk. These receptacles have moving parts such as: hinges or spring-loaded latches or a foot pedal used to open doors or flaps in order to remove the plunger. They are held together by screws or rivets or adhesives. These receptacles with moving parts only increase the chance of something breaking, leaving the receptacle unusable. Invention U.S. Pat. No. 7,900,287 B2 inventor Wildauer, Agami, and Metaxatos invented a plunger handle and canister with implements that requires a disposable plunger be attached to a plunger handle before use. The time it takes to prepare this plunger is too long. The present invention, the waterproof mat, would have the plunger in hand immediately. FIG. 2 The mat allows the plunger to be placed basically wherever a plunger can be placed, requiring no preparation prior to use.

The steps taken, when using the present invention include first, lifting the plunger by hand, second, unclogging the toilet or drain, third, rinse and shake off excess water, and four, replacing the plunger on the mat.

What is claimed is:

1. A device for storing a toilet plunger comprising:

a toilet plunger and a toilet plunger holder; wherein, the toilet plunger holder further comprises:

a bottom layer made of rubber, a top layer made of clear rubber, and a design layer sandwiched between the top and bottom layer which is made of fabric;

and wherein the top layer has a vertically raised edge and the bottom layer has a flat base.

2. The device of claim 1, wherein said toilet plunger holder is waterproof.

3. The device of claim 1, wherein said design layer comprises a logo, advertisement, team sports letter or mascot.

4. The device of claim 1, wherein said toilet plunger holder can comprise a circular or square shape.

* * * * *